US011300278B2

(12) United States Patent
Hur

(10) Patent No.: US 11,300,278 B2
(45) Date of Patent: Apr. 12, 2022

(54) BAND TYPE HEAD LANTERN AND MANUFACTURING METHOD THEREOF

(71) Applicant: HURKINS CO., LTD, Daegu (KR)

(72) Inventor: Ji Uk Hur, Seoul (KR)

(73) Assignee: HURKINS CO., LTD, Daegu (KR)

( * ) Notice: Subject to any disclaimer, the term of this patent is extended or adjusted under 35 U.S.C. 154(b) by 172 days.

(21) Appl. No.: 16/616,243

(22) PCT Filed: Nov. 19, 2019

(86) PCT No.: PCT/KR2019/015890
§ 371 (c)(1),
(2) Date: Nov. 22, 2019

(87) PCT Pub. No.: WO2021/090995
PCT Pub. Date: May 14, 2021

(65) Prior Publication Data

US 2021/0332972 A1 Oct. 28, 2021

(30) Foreign Application Priority Data

Nov. 7, 2019 (KR) ..... 10-2019-0142137

(51) Int. Cl.

| | |
|---|---|
| ***F21V 21/084*** | (2006.01) |
| ***F21L 4/02*** | (2006.01) |
| ***F21V 5/04*** | (2006.01) |
| *F21Y 115/10* | (2016.01) |
| *F21Y 103/10* | (2016.01) |

(52) U.S. Cl.
CPC ..... *F21V 21/084* (2013.01); *F21L 4/027* (2013.01); *F21V 5/04* (2013.01); *F21Y 2103/10* (2016.08); *F21Y 2115/10* (2016.08)

(58) Field of Classification Search
CPC . F21V 21/084; A61B 2090/502; A42B 1/244; A42B 3/044; A42B 3/0446; F21L 4/027; F21Y 2103/10
See application file for complete search history.

(56) References Cited

U.S. PATENT DOCUMENTS 5,469,342 A * 11/1995 Chien ..... A42B 1/242 224/660
5,836,673 A * 11/1998 Lo ..... A41D 13/01 362/184

(Continued)

FOREIGN PATENT DOCUMENTS

| | | |
|---|---|---|
| KR | 20-2013-005245 U | 9/2013 |
| KR | 10-1693760 B1 | 1/2017 |
| KR | 10-1719271 B1 | 3/2017 |

*Primary Examiner* — Rajarshi Chakraborty
*Assistant Examiner* — Michael Chiang
(74) *Attorney, Agent, or Firm* — Novick, Kim & Lee, PLLC; Jae Youn Kim; Jihun Kim

(57) ABSTRACT

The present invention relates to a band type head lantern and a manufacturing method thereof and, more particularly, to a band type head lantern for easily securing a forward visual field, and a method of manufacturing the band type head lantern. The band type head lantern of the present invention includes: a band part provided to be worn on the head of a user; a seat part attached to the front of the band part; a light emission part coupled to the front of the seat part; a lens part coupled to the front of the light emission part; and a cover part provided to cover the emission part and the lens part.

8 Claims, 16 Drawing Sheets

(56) References Cited

U.S. PATENT DOCUMENTS

| | | | | |
|---|---|---|---|---|
| 8,157,402 | B2 * | 4/2012 | Huss | A42B 3/044 362/106 |
| 9,271,343 | B2 * | 2/2016 | Mackool | F21V 23/0464 |
| 10,859,245 | B2 * | 12/2020 | Gall | F21V 21/084 |
| 2013/0223070 | A1 * | 8/2013 | Baker | A42B 3/044 362/244 |
| 2014/0268683 | A1 * | 9/2014 | Waters | A42B 1/244 362/106 |
| 2018/0058681 | A1 * | 3/2018 | Arave | F21V 21/084 |
| 2018/0302963 | A1 * | 10/2018 | Fu | H05B 45/48 |
| 2019/0390844 | A1 * | 12/2019 | Sedlacek | F21V 21/084 |
| 2021/0215326 | A1 * | 7/2021 | Besley | F21V 29/10 |

* cited by examiner

BAND TYPE HEAD LANTERN AND MANUFACTURING METHOD THEREOF

BACKGROUND OF THE INVENTION

Field of the Invention

The present invention relates to a band type head lantern and a manufacturing method thereof and, more particularly, to a band type head lantern for easily securing a forward visual field, and a method of manufacturing the band type head lantern.

Description of the Related Art

In general, head lanterns or lanterns are used to secure a forward visual field at night or at dark places, and lanterns having various shapes and designs including an LED instead of a bulb and a small-sized battery have been developed and used with technological development instead of a conventional type that has a battery in a body having a bulb to be turned on when a switch is operated.

In these lanterns, a band type head lantern that is worn on the user's head in a band type so that the user can freely use both hands has been developed and used. There are also various band type head lanterns, and a representative example is described as follows with reference to a patent document.

According to Korean Utility Model Application No. 20-2012-0001506, the effect of wearing is improved by using the elasticity of an elliptical ring shape having a new moon shape that uses a band shape, a light emitting body is inserted in a high-illumination LED lantern at the center, the frame in which the light emitting body is inserted is adjusted in angle to 45 degrees, and the center of the elliptical ring is foldable.

Korean Patent No. 10-1693760 relates to a head lantern in which a battery is compatible such that a user can selectively use a chargeable battery for supplying power to the head lantern and for supplying power an electric tool. The head lantern includes: a lantern unit that is worn on a head and radiates light forward from a user; and a battery unit that is electrically connected with the lantern unit, installed to be worn on a waistband of a user, and supplies power to the lantern unit and charges a battery.

Korean Patent No. 10-1719271 relates to a head lantern that is worn on a head and can irradiate the front area from a user in outdoor activities such as climbing, fishing, or camping. In more detail, a general light emitting unit, an intensive light emitting unit, and an expansive light emitting unit by LEDs are separately formed on the front of the lantern such that they can be selectively used, a fastening part of which the angle can be adjusted and a holder rotating from the coupling part are disposed on the rear of the lantern, and a fastening thread groove that can be used in a stand type is formed on the bottom of the lantern.

These lanterns in the related art described above are worn on the user's head or a hat, thereby being able to sufficiently accomplish the fundamental purpose of securing a forward visual field and enabling the user to freely use both hands.

However, it is generally addressed to secure a visual field for a wider area and irradiate a longer distance forward by increasing the brightness of LEDs, so the capacity of batteries are increased, thereby causing a burden in acting for a long time with the lanterns on a head or a hat.

Since the illumination is high, it is possible to irradiate a wide and far forward area, but when a user moves with the lanterns on, other people who take exercise or take a walk is dazzled by the light. If other people are pedestrians, they can temporarily stop and then resume walking, but if other people are exercising using bicycles or are drivers of vehicles, they cannot instantaneously see the front area, so they may cause safety accidents such as a collision/rear-end collision.

Further, when a user wears a high-illumination head lantern, the light is radiated even toward the user's eyes, which is rather another reason that makes it difficult for the user to secure a forward visual field due to dazzling.

In particular, according to the head lanterns of the prior art or the related art, since light is radiated forward to a long distance, it causes dazzling to opposite people. Further, the light is not radiated wide to both sides, so it may be suitable for intensively irradiating one place, but it is inconvenient when securing a wide visual field.

Further, there is a need for a specific reflective plate to prevent light from diffusing rearward from the lens, so the structure of the lens is complicated and manufacturing is difficult. Further, the lenses of the related art is configured to prevent light from being radiated in specific directions by diffusing light or further having a specific reflective member, so there are several problems including that it is impossible to fundamentally prevent scattered reflection and diffusion of light.

CITATION LIST

Patent Literature

Patent Literature 1: Korean Utility Model Application No. 20-2012-0001506

SUMMARY OF THE INVENTION

In order to solve these problems, an object of the present invention is to provide a band type head lantern for easily securing a forward visual field, and a method of manufacturing the band type head lantern.

The objects to implement in the present invention are not limited to the technical problems described above and other objects that are not stated herein will be clearly understood by those skilled in the art from the following specifications.

In order to achieve the objects, the present invention provides a band type head lantern including: a band part provided to be worn on the head of a user; a seat part attached to the front of the band part; a light emission part coupled to the front of the seat part; a lens part coupled to the front of the light emission part; and a cover part provided to cover the emission part and the lens part, in which the light emission part includes: a flexible substrate coupled to the seat part; first light emission modules that are a plurality of light emission elements arranged with predetermined intervals toward both sides from a center of the substrate; second light emission modules spaced predetermined intervals apart from each other at both sides of the first light emission modules; and third light emission modules formed on the substrate and formed outside the second light emission modules.

In an embodiment of the present invention, the seat part has: a coupling groove in which the light emission part is inserted and coupled; a top rim extending forward from a top of the coupling groove; and a bottom rim extending forward from a bottom of the coupling groove.

In an embodiment of the present invention, a center of the first light emission module is positioned higher than the center of the substrate, and the second light emission module and the third light emission module vertically extends longer than the first light emission module.

In an embodiment of the present invention, the bottom rim of the seat part protrudes at an area corresponding to the first light emission module further than areas corresponding to the second light emission module and the third light emission module to prevent light radiated from the first light emission module from diffusing to user's eyes.

In an embodiment of the present invention, the lens part includes: a lens band formed to cover the front of the substrate; and a lens body protruding in a semispherical shape from the lens band and formed at a position corresponding to the first light emission module and the second light emission module, in which the lens body is not formed at a position corresponding to the third light emission module.

In an embodiment of the present invention, the lens part further has light emission element grooves formed on a rear of the lens body so that the first light emission modules and the second light emission modules arranged on the substrate are positioned therein.

In an embodiment of the present invention, the light emission element grooves formed at positions corresponding to the first light emission modules are deeper at a lower portion than an upper portion to incline downward such that light radiated from the first light emission modules travels forward at 20 to 90 degrees with respect to a rear vertical surface of the lens body.

In an embodiment of the present invention, the light emission element grooves formed at positions corresponding to the second light emission modules are deeper at a lower portion than an upper portion to incline downward such that light radiated from the second light emission modules travels forward at 0 to 20 degrees with respect to a rear vertical surface of the lens body.

In an embodiment of the present invention, the light emission element grooves formed at positions corresponding to the second light emission modules are provided such that light radiated from the second light emission modules travels forward to a portion of an area between 0 to 20 degrees with respect to the rear vertical surface of the lens body.

In order to achieve the objects, the present invention provides a method of manufacturing the band type head lantern, the method including: a) putting the lens unit on the front of the light emission part; b) inserting the light emission part with the lens part on the front into the cover tube; c) forming a cover part by coating the cover tube on the lens part and the light emission part by heating the cover tube with the lens part and the light emission part inserted therein; and d) inserting the cover part into the seat part with the band part and the seat part bent in an arc shape.

DETAILED DESCRIPTION OF THE PREFERRED EMBODIMENTS

Figure 1:
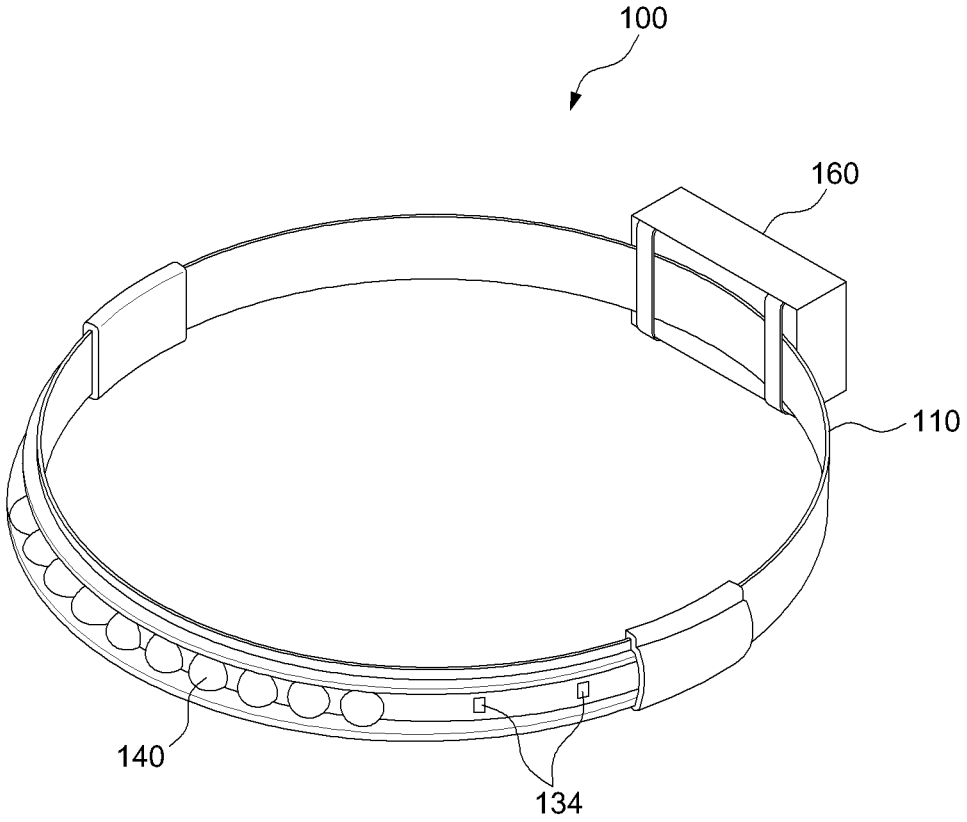
FIG. 1 is a perspective view of a band type head lantern according to an embodiment of the present invention.

Hereinafter, the present invention is described with reference to the accompanying drawings. However, the present invention may be modified in various different ways and is not limited to the embodiments described herein. Further, in the accompanying drawings, components irrelevant to the description will be omitted in order to obviously describe the present invention, and similar reference numerals will be used to describe similar components throughout the specification.

Throughout the specification, when an element is referred to as being "connected with (coupled to, combined with, in contact with)" another element, it may be "directly connected" to the other element and may also be "indirectly connected" to the other element with another element intervening therebetween. Further, unless explicitly described otherwise, "comprising" any components will be understood to imply the inclusion of other components rather than the exclusion of any other components.

Terms used in the present invention are used only in order to describe specific exemplary embodiments rather than limiting the present invention. Singular forms are intended to include plural forms unless the context clearly indicates otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

Hereinafter, embodiments are described in detail with reference to the accompanying drawings.

Figure 2:
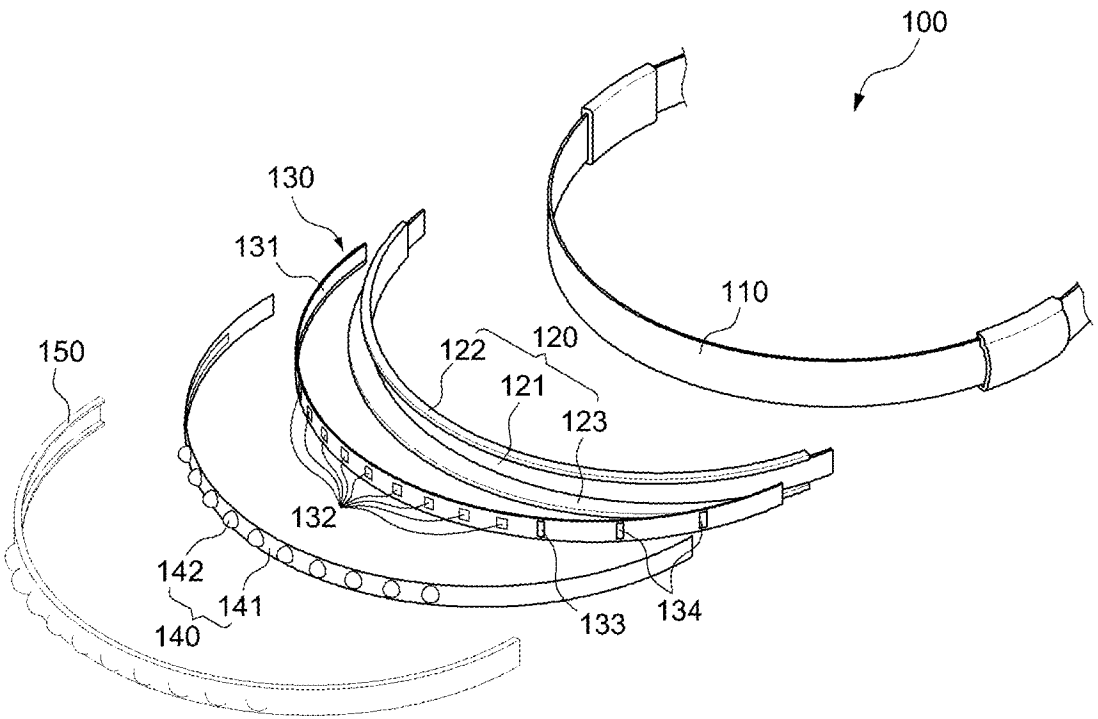
FIG. 2 is an exploded perspective view of the band type head lantern according to an embodiment of the present invention.

FIG. 1 is a perspective view of a band type head lantern according to an embodiment of the present invention, and FIG. 2 is an exploded perspective view of the band type head lantern according to an embodiment of the present invention.

As shown in FIGS. 1 and 2, a band type head lantern 100 includes a band part 110, a seat part 120, a light emission part 130, a lens part 140, a cover part 150, and a controller 160.

The band part 110 may be provided in a band shape so that a user can wear the lantern on his/her head or a hat.

In detail, the band part 110 may be made of an elastic material and may be provided in a type with an adjustable length.

The seat part 120 is attached to the front of the band part 110 and may be provided in an arc shape to correspond to the shape of the band part 110.

The seat part 120 may have a coupling groove 121, a top rim 122, and a bottom rim 123.

The coupling groove 121 may be provided in a groove shape so that the light emission part 130 can be inserted therein. The length of the coupling groove 121 may correspond to the length of the light emission part 130.

The top rim 122 may extend forward from the top of the coupling groove 121.

The bottom rim 123 may extend forward from the bottom of the coupling groove 121.

Since the top rim 122 and the bottom rim 123 extend forward, as described, a groove may be formed in the coupling groove 121.

The coupling groove 121, the top rim 122, and the bottom rim 123 may be integrally formed.

Further, the bottom rim 123 may partially further protrude forward to be able to prevent dazzling due to light that is radiated from the light emission part 130 and diffused to the user's eyes. The protrusive length L of the bottom rim 123 may be set such that the end of the bottom rim meets or further protrudes than an extension line of a downward radiation angle 'a' of the light radiated from the light emission part 130.

Figure 3:
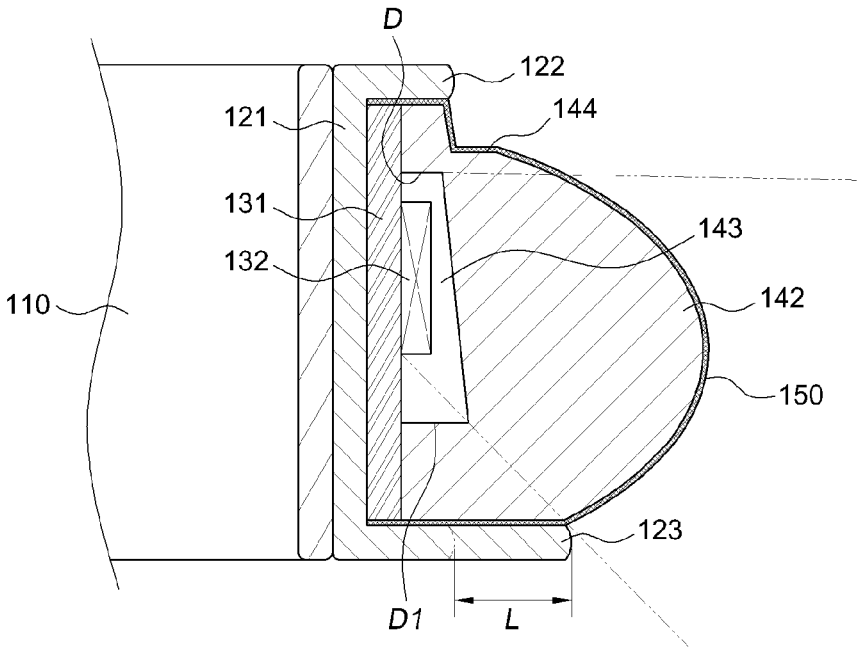
FIGS. 3 and 4 are vertical cross-sectional views of a first light emission module of the band type head lantern according to an embodiment of the present invention.
Figure 4:
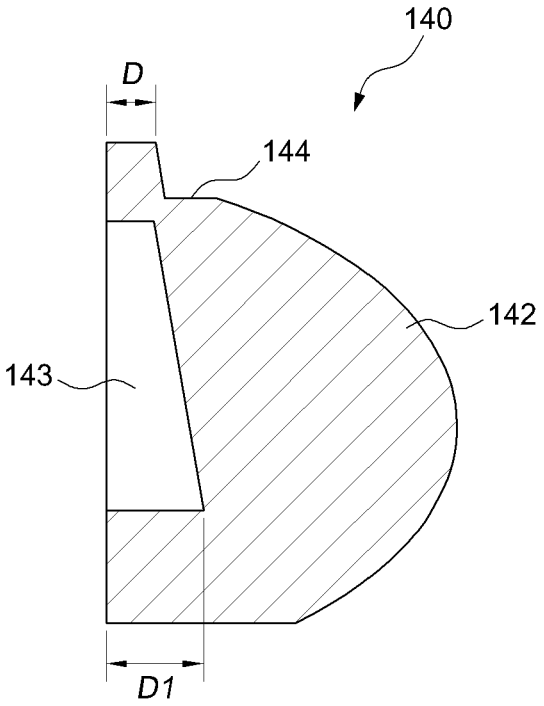
Figure 5:
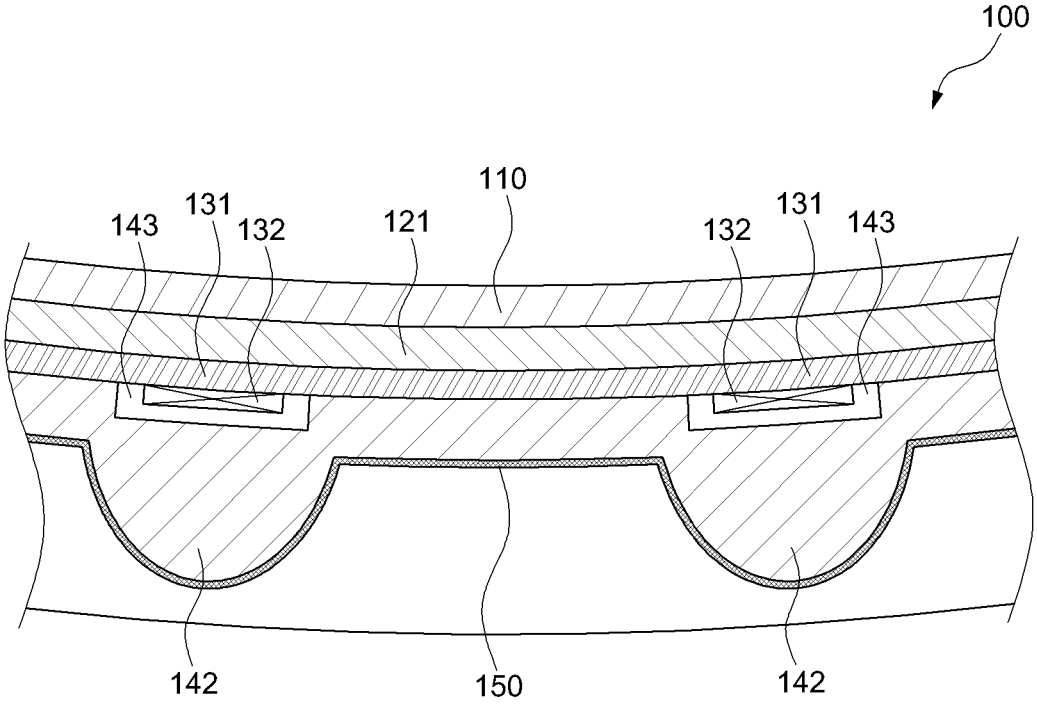
FIG. 5 is a horizontal cross-sectional view of the first light emission module of the band type head lantern according to an embodiment of the present invention.
Figure 6:
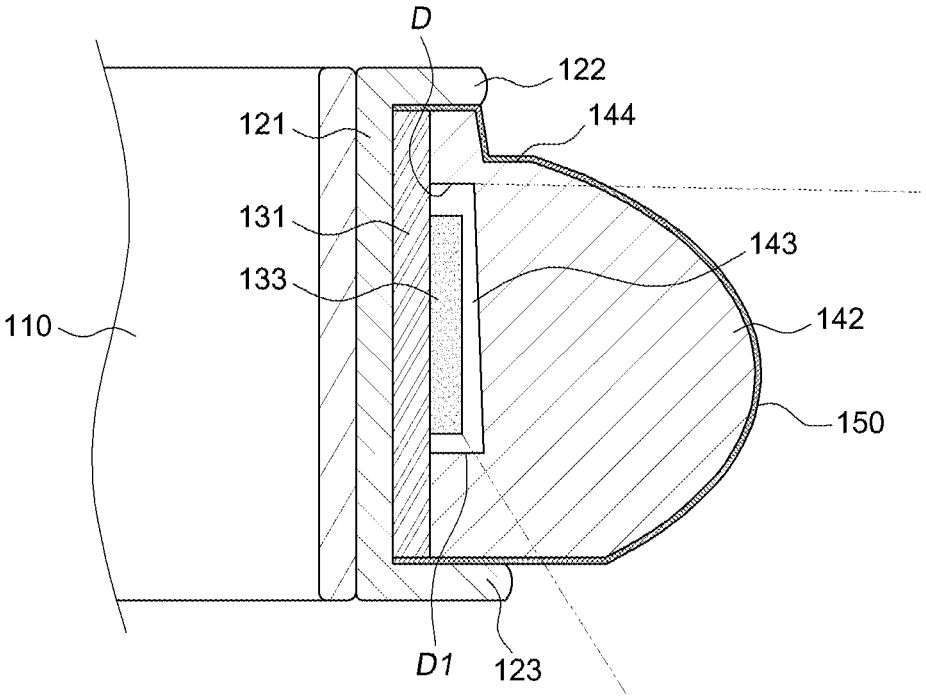
FIG. 6 is a vertical cross-sectional view of a second light emission module of the band type head lantern according to an embodiment of the present invention.

FIGS. 3 and 4 are vertical cross-sectional views of a first light emission module of the band type head lantern according to an embodiment of the present invention, and FIG. 5 is a horizontal cross-sectional view of the first light emission module of the band type head lantern according to an embodiment of the present invention. Further, FIG. 6 is a vertical cross-sectional view of a second light emission module of the band type head lantern according to an embodiment of the present invention.

Referring to FIGS. 3 to 6, the light emission part 130 may be coupled to the front of the seat part 120 and may radiate light by receiving power by the controller 160.

In detail, the light emission part 130 includes a substrate 131, first light emission modules 132, second light emission modules 133, and third light emission modules 134.

The substrate 131 is inserted and coupled in the coupling groove 121 of the seat part 120 and may be made of a flexible material.

The first light emission modules 132 may be a plurality of light emission elements arranged with predetermined intervals toward both sides from the center of the substrate 131.

The first light emission modules 132 may be distributed within 90 degrees to both sides from the center of the substrate 131. The predetermined intervals may be regular intervals or irregular intervals.

The second light emission modules 133 may be formed on the substrate 131 and may be spaced predetermined intervals apart from each other at both sides of the first light emission modules 132. The predetermined intervals may be regular intervals or irregular intervals.

The third light emission modules 134 may be formed on the substrate 131 and may be formed outside the first light emission modules 132.

The centers of the first light emission modules 132 may be positioned higher than the center of the substrate 131, and the second light emission modules 133 and the third light emission module 134 may be vertically further extend than the first light emission modules 132.

Further, the bottom rim 123 of the seat part 120 may further protrude forward at the area corresponding to the first light emission modules 132 than at the areas corresponding to the second light emission modules 133 and the third light emission modules 134 to prevent the light radiated from the first light emission modules 132 from diffusing toward the user's eyes.

The lens part 140 is coupled to the front of the light emission part 130 and includes a lens band 141, lens bodies 142, light emission element grooves 143, and a top radiation surface 144.

The lens band 141 may be formed to cover the front of the substrate 131.

Further, the lens band 141 may be made of a silicon material, which has optical efficiency over 97%, has high heat resistance, and does not yellow and change in material, in a band type.

The lens bodies 142 protrude in a semispherical shape from the lens body 141 and may be formed at positions corresponding to the first light emission module 132 and the second light emission module 133. The lens bodies 142 may be characterized by being not formed at positions corresponding to the third light emission modules 134.

The light emission element grooves 143 are formed on the rear of the lens body 142 so that the first light emission modules 132 and the second light emission modules 133 arranged on the substrate 131 are positioned therein.

In more detail, the light emission element groove 143 formed at a position corresponding to the first light emission module 132 is deeper at the lower portion than the upper portion, thereby inclining downward. Accordingly, the light radiated from the first light emission module 132 can travel forward at 20 to 90 degrees with respect to the rear vertical surface of the lens body 142.

The light emission element groove 143 formed at a position corresponding to the second light emission module 133 is deeper at the lower portion than the upper portion, thereby inclining downward. Accordingly, the light radiated from the second light emission module 133 can travel forward at 0 to 20 degrees with respect to the rear vertical surface of the lens body 142.

The top radiation surface 144 may be provided at the upper portion of the lens body 142 to induce straight traveling of light.

As described above, since a radiation groove that does not extend to communicate with the light emission element groove 143 is formed inside the lens body 142, the light from the first light emission module 131 and the second light emission module 132 travels forward at an angle downward through the radiation groove without diffusing throughout the lens unit 140. Accordingly, it is possible to prevent dazzling of opposite pedestrians, bicycles, and vehicles and to secure a safe and sufficient forward visual field.

Figure 7:
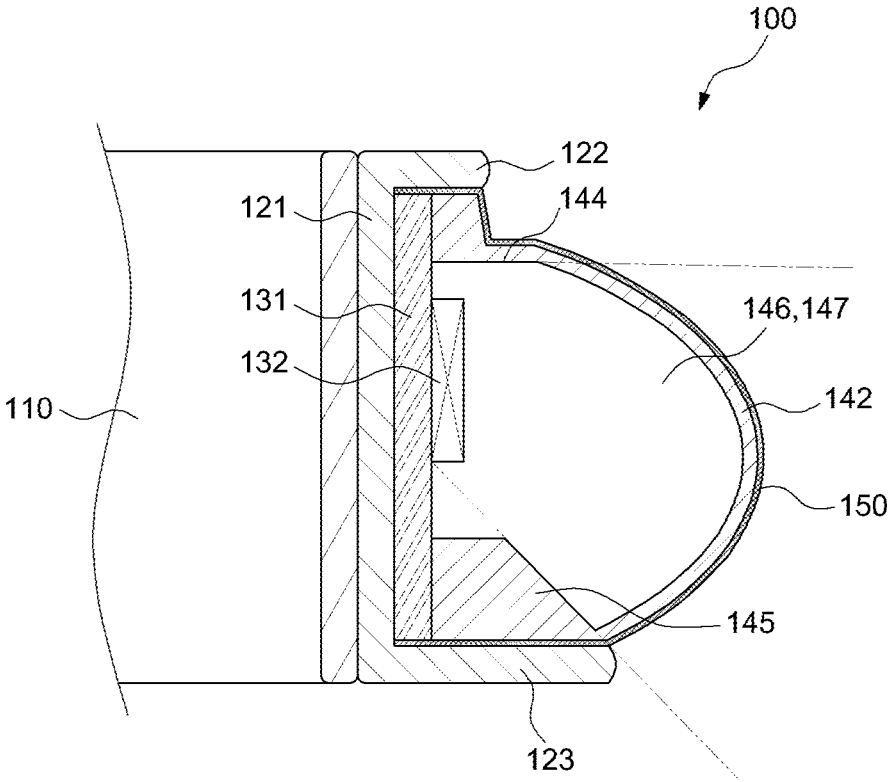
FIG. 7 is a horizontal cross-sectional view of a first light emission module of a band type head lantern according to another embodiment of the present invention.

FIG. 7 is a horizontal cross-sectional view of a first light emission module of a band type head lantern according to another embodiment of the present invention.

Referring to FIG. 7, a radiation groove may be further formed toward the front of the lens body 142 from the light emission element groove 143 in the lens part 140.

In detail, the radiation groove formed at a position corresponding to the first light emission module 132, when seen from a side of the lens body 142, may have a top radiation surface 144 positioned at an upper portion of the radiation groove, a first bottom radiation surface 145 positioned at a lower portion, and a left radiation surface 146 and a right radiation surface 147 positioned at left and right sides, respectively.

The top radiation surface 144 may be perpendicular or inclined downward with respect to the vertical surface of the light emission element groove 143.

The first bottom radiation surface 145 may have an inclination of about 20 degrees downward with respect to the vertical surface of the light emission element groove 143.

When seen in a plan cross-section of the lens body 122, the left and right radiation surfaces 146 and 147 positioned at both sides of the radiation groove may be formed not to excessively widely expand to sides in order not to interfere with the light from adjacent light emission elements.

Figure 8:
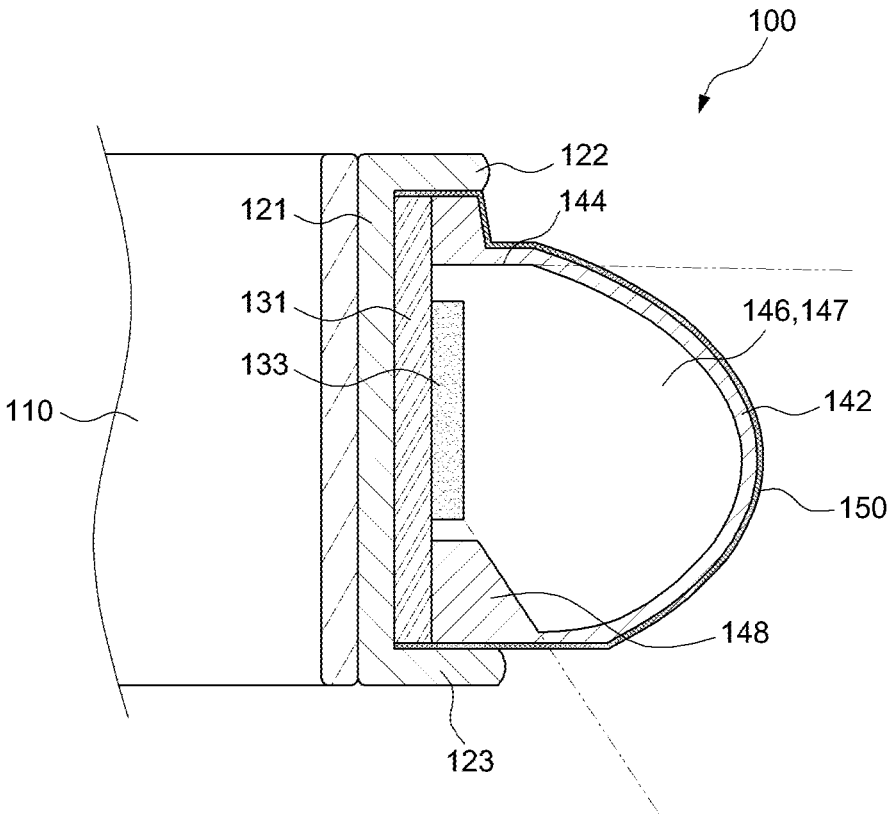
FIG. 8 is a horizontal cross-sectional view of a second light emission module of the band type head lantern according to another embodiment of the present invention.

FIG. 8 is a horizontal cross-sectional view of a second light emission module of the band type head lantern according to another embodiment of the present invention.

Referring to FIG. 8, in detail, the radiation groove formed at a position corresponding to the second light emission module 133, when seen from a side of the lens body 142, may have a top radiation surface 144 positioned at an upper portion of the radiation groove, a second bottom radiation surface 148 positioned at a lower portion, and a left radiation surface 146 and a right radiation surface 147 positioned at left and right sides, respectively.

The top radiation surface 144 may be perpendicular or inclined downward with respect to the vertical surface of the light emission element groove 143.

The second bottom radiation surface 148 may have an inclination of about 0 to 20 degrees downward with respect to the vertical surface of the light emission element groove 143.

When seen in a plan cross-section of the lens body 122, the left and right radiation surfaces 146 and 147 positioned at both sides of the radiation groove may be formed not to excessively widely expand to sides in order not to interfere with the light from adjacent light emission elements.

That is, the radiation groove formed at a position corresponding to the second light emission module 133 can make a light emission angle face the area around the user's feet in comparison to the first light emission module 132.

Further, the radiation groove has a predetermined thickness, as shown in the figures, without passing through the lens body 142, thereby being able to prevent contamination due to foreign substances entering inside from the outside.

Figure 9:
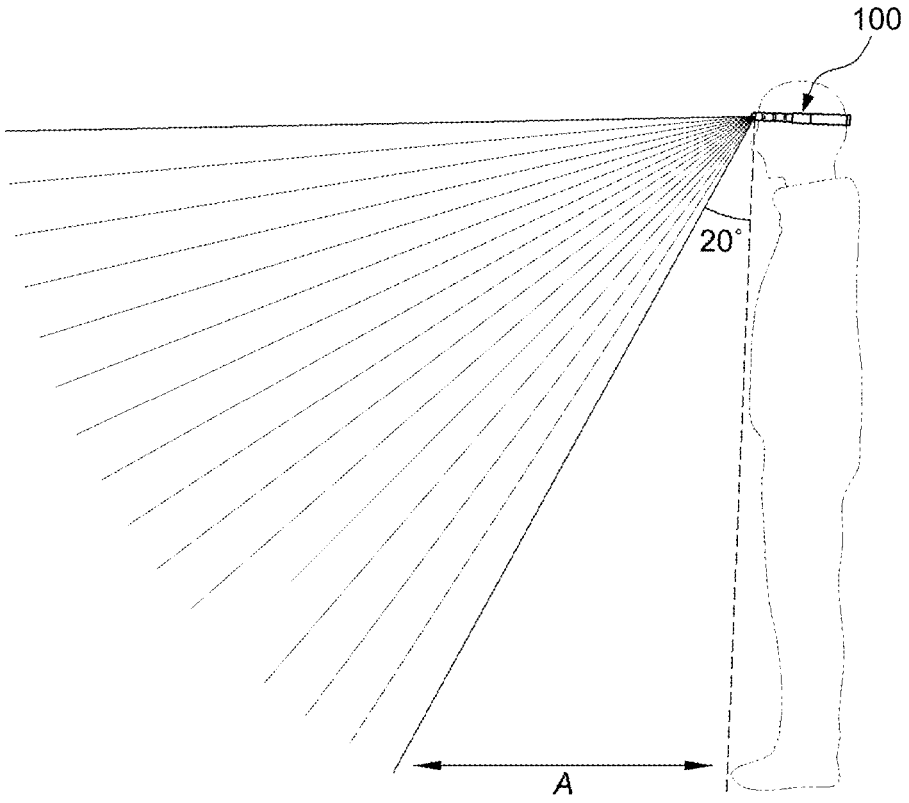
FIGS. 9 to 11 are exemplary views showing a light emission angle of the band type head lantern according to an embodiment of the present invention.
Figure 10:
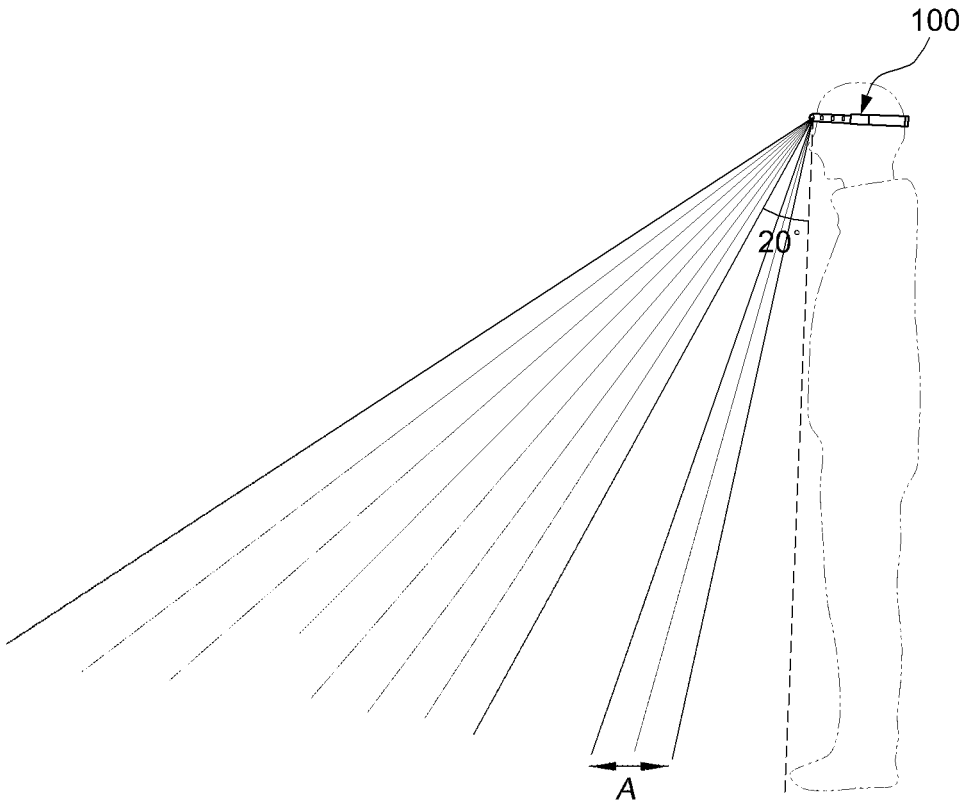
Figure 11:
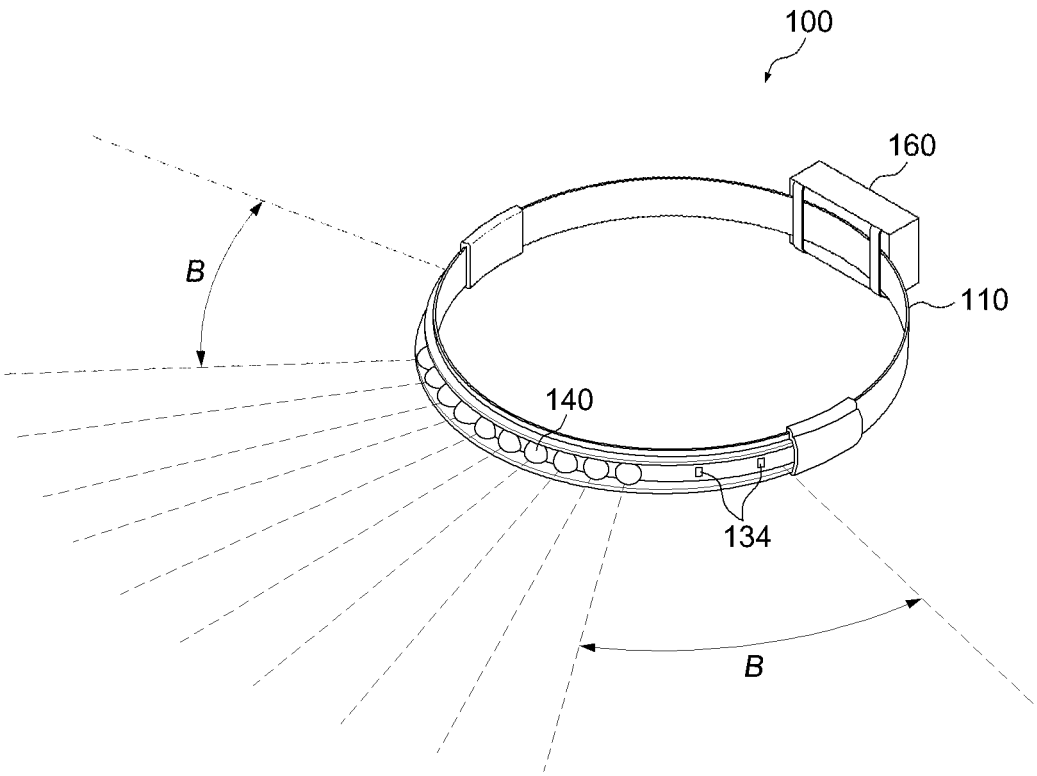

FIGS. 9 to 11 are exemplary views showing a light emission angle of the band type head lantern according to an embodiment of the present invention.

In detail, referring to FIGS. 9 to 11, the first light emission module 132 provided, as described above, radiates light forward at an angle of 90° or less with respect to the rear vertical surface of the lens body 142 but does not radiate light downward at 20° or less with respect to the rear vertical surface of the lens body 142. The light radiated from the first light emission module 132 can be radiated maximally to 30 m on the ground.

In particular, light from LEDs has strong straightness, so when only the first light emission modules 132 are provided, the area A around the user's feet may not be seen because it is dark.

However, in the present invention, since the second light emission modules 133 disposed at both sides of the first light emission module 132 irradiate an area between 0 to 20 degrees with respect to the rear vertical surface of the lens body 142, so the user can safely walk.

The second light emission module 1333 may irradiate a predetermined area between 0 to 20 degrees with respect to the rear vertical surface of the lens body 142.

Further, according to the present invention, the third light emission modules 134 do not have the lens body 142, so they do not radiate light toward the area around the user's feet. That is, the third light emission modules 133 irradiate areas B at both sides of the area that the first light emission modules 132 and the second light emission modules 133 irradiate, thereby being able to secure a wider visual field to the left and right.

That is, in the present invention, the light emission modules are arranged in an arc shape within about 180° including the front and the sides of the band part 110 and the lens units 140 radiates light forward and downward widely with straightness, thereby being able to secure a wide visual field.

The cover part 140 is provided to cover the light emission part 120 and the lens part 130, thereby being able to prevent water or foreign substances from entering the lens unit 130 and damaging and contaminating the lens part 130. Further, the cover part 140 may be made of a transparent material to be able to transmit light.

The controller 160 is disposed behind the band part 110 and has a battery and a switch for operation.

According to the present invention described above, it is possible to radiate light forward to a wide area with high straightness, and it is also possible to enable a user to easily secure a visual field by reducing diffusion and scattered reflection of the light radiated from the light emission part 130 while preventing dazzling of not only the user, but opposite people, bicycles, and vehicles. Accordingly, there is an advantage that it is possible to improve convenience in used and increase the quality and durability.

Figure 12:
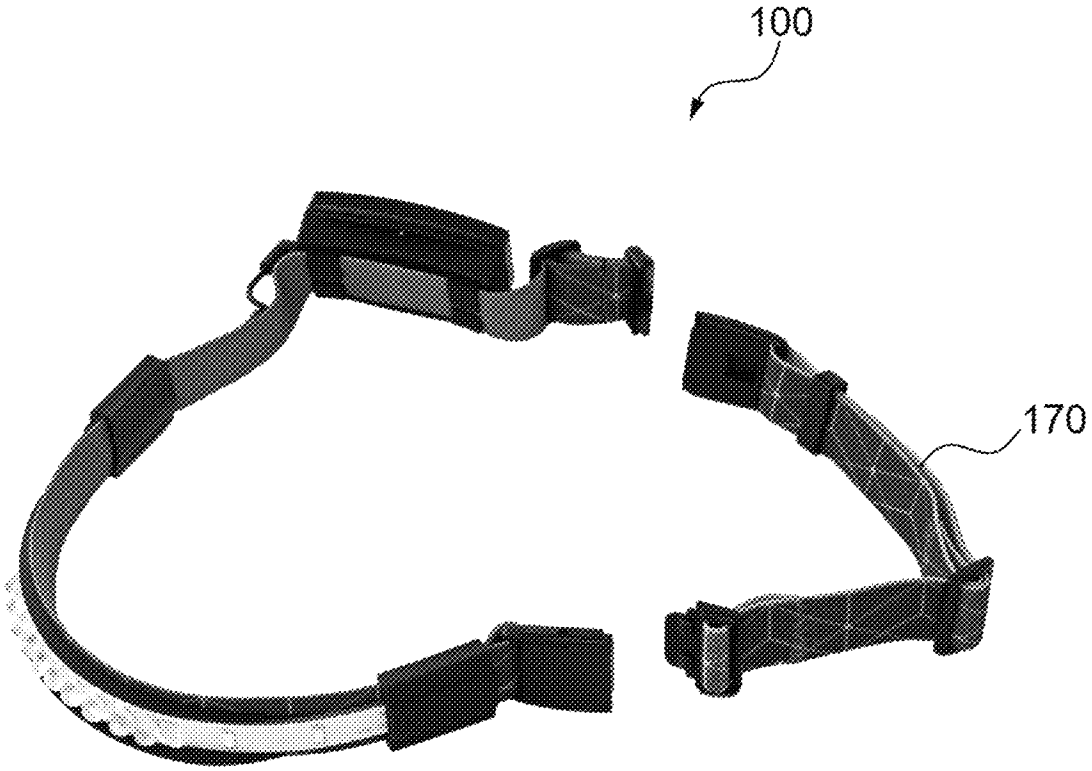
FIG. 12 is a picture showing an extension of the band type head lantern according to an embodiment of the present invention.

FIG. 12 is a picture showing an extension of the band type head lantern according to an embodiment of the present invention.

Referring to FIG. 12, the band type head lantern 100 of the present invention may further includes an extension 170.

The extension 170 is connected to a portion of the band part 110, thereby being able to increase the entire length of the band part 110.

That is, although the band part 110 can be worn on a head, but when the length of the band part 110 is increased by the extension 170, the band part 110 can be worn on a chest or a waist.

The band part 110 is partially formed like a buckle, so it can be detachably attached. Further, the extension 170 is also formed like a buckle at both ends, so it can be coupled to the buckle of the band part 110 to extend.

However, the coupling method of the band part 110 and the extension 170 is not limited thereto.

Figure 13:
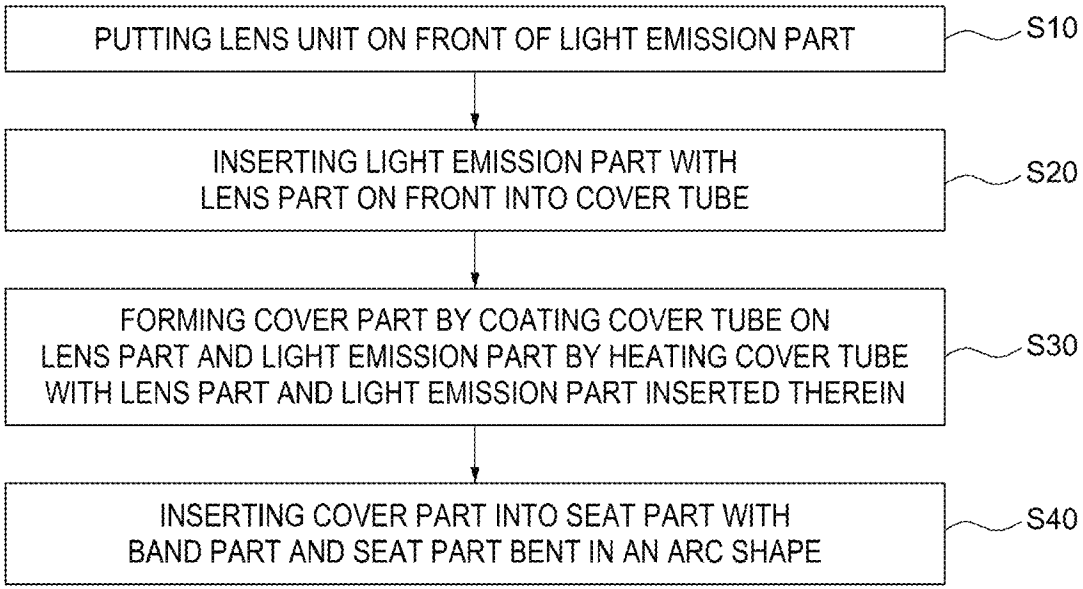
FIG. 13 is a flowchart showing a method of manufacturing a band type head lantern according to an embodiment of the present invention.

FIG. 13 is a flowchart showing a method of manufacturing a band type head lantern according to an embodiment of the present invention.

A method of manufacturing the band type head lantern 100 is described with reference to FIG. 13.

The method of manufacturing the band type head lantern, first, performs a step of putting the lens unit on the front of the light emission part (S10).

Figure 14:
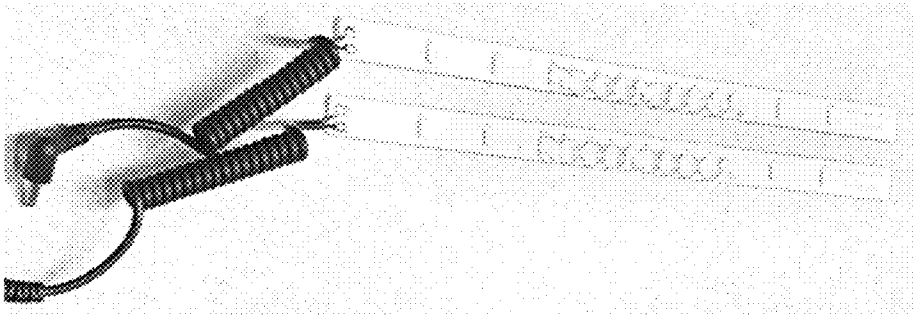
FIG. 14 is an exemplary picture showing a step of putting a lens part on the front of a light emission part according to an embodiment of the present invention.

FIG. 14 is an exemplary picture showing a step of putting a lens unit on the front of a light emission unit according to an embodiment of the present invention.

Referring to FIG. 14, in the step of putting the lens part on the front of the light emission part (S10), the lens part 140 can be put on the front of the light emission part 130. In this step, the lens bodies 142 can be positioned on the fronts of the corresponding first light emission module 132 and second light emission modules 133.

After the step of putting the lens unit on the front of the light emission unit (S10), the method may perform a step of inserting the light emission part with the lens part on the front into the cover tube (S20).

Figure 15:
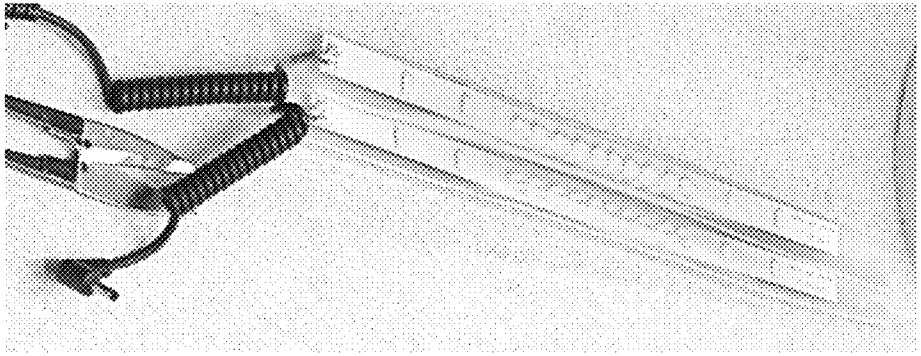
FIG. 15 is an exemplary picture showing a step of inserting the light emission part with the lens part on the front into a cover tube according to an embodiment of the present invention.

FIG. 15 is an exemplary picture showing a step of inserting the light emission unit with the lens unit on the front into a cover tube according to an embodiment of the present invention.

Referring to FIG. 15, in the step of inserting the light emission part with the lens part on the front into the cover tube (S20), the lens unit 140 and the light emission unit 130 can be inserted into the cover tube in an overlap state.

After the step of inserting the light emission part with the lens part on the front into the cover tube (S20), the method may perform a step of forming a cover part by coating the cover tube on the lens part and the light emission part by heating the cover tube with the lens part and the light emission part inserted therein (S30).

Figure 16:
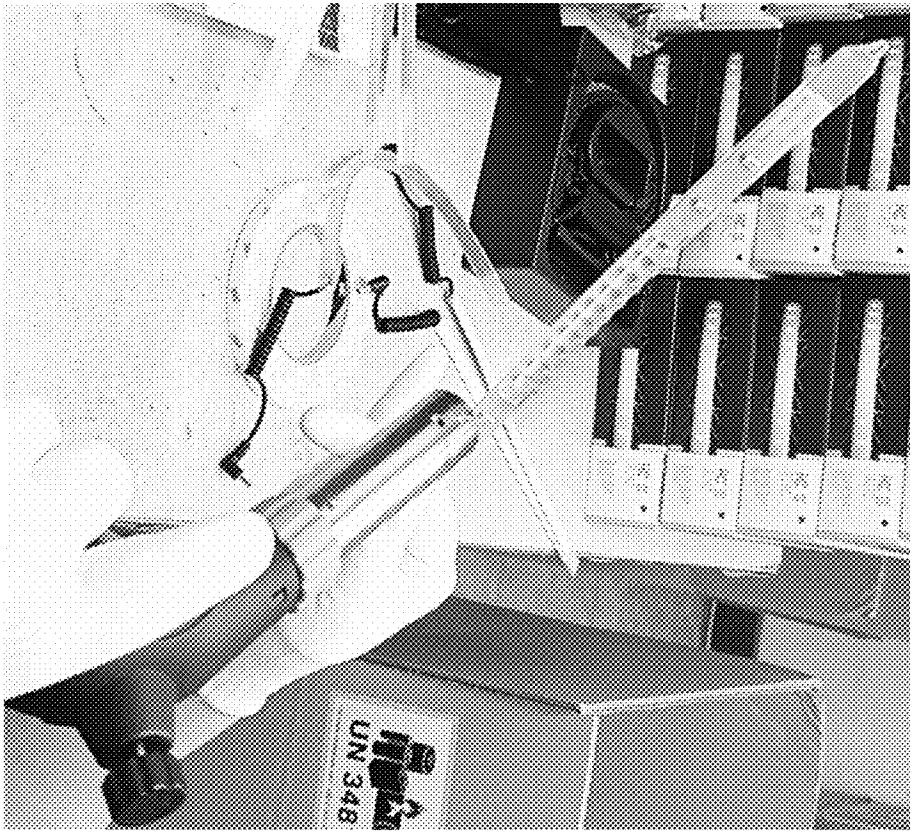
FIG. 16 is an exemplary picture showing a step of forming a cover part by coating the cover tube on the lens part and the light emission part by heating the cover tube with the lens part and the light emission part inserted therein, in accordance with an embodiment of the present invention.

FIG. 16 is an exemplary picture showing a step of forming a cover by coating the cover tube on the lens unit and the light emission unit by heating the cover tube with the lens unit and the light emission unit inserted therein, in accordance with an embodiment of the present invention.

Referring to FIG. 16, in the step of forming a cover part by coating the cover tube on the lens part and the light emission part by heating the cover tube with the lens part and the light emission part inserted therein (S30), when heat is applied to the cover tube, the cover tube contracts.

The contracting cover tube can be coated by contracting while bringing the lens part 140 and the light emission part 130 in close contact with each other. In particular, since the cover tube is coated in this way, the cover tube can be coated in close contact while deforming to correspond to the curve of the lens part 140.

As described above, the cover part 150 having the cover tube coated in close contact with the lens part 140 can prevent the problem with scattered reflection and refraction of light radiated from the lens unit 140 and can achieve waterproofing.

After the step of forming a cover part by coating the cover tube on the lens part and the light emission part by heating the cover tube with the lens part and the light emission part inserted therein (S30), the method may perform a step of inserting the cover part into the seat part with the band part and the seat part bent in an arc shape (S40).

Figure 17:
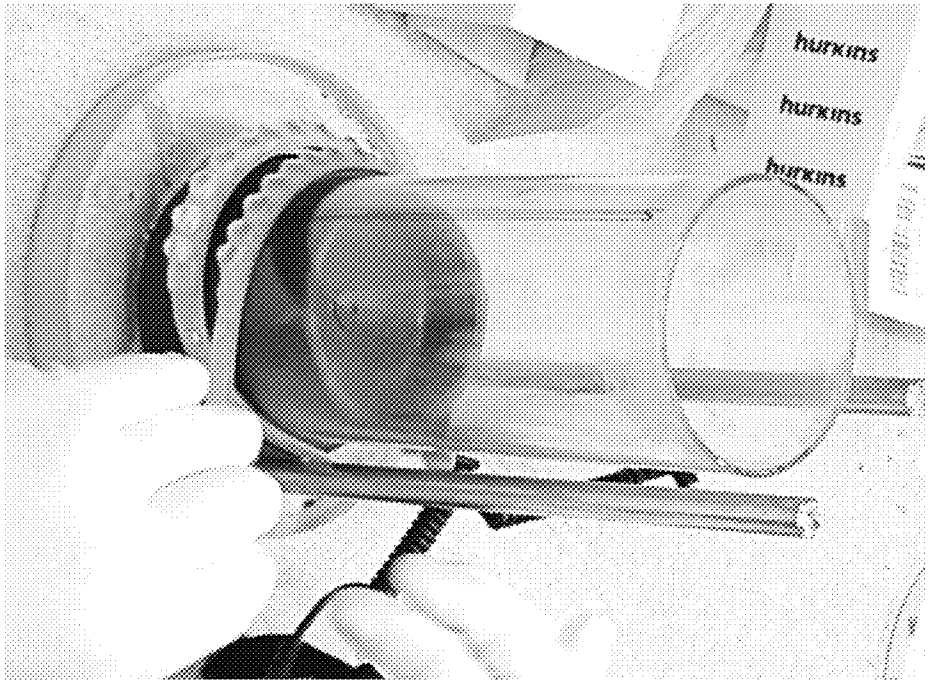
FIG. 17 is an exemplary picture showing a step of combining a cover by inserting the cover part into a seat part with a band part and the seat part according to an embodiment of the present invention bent in an arc shape.

FIG. 17 is an exemplary picture showing a step of combining a cover by inserting the cover part into a seat part with a band part and a seat part according to an embodiment of the present invention bent in an arc shape.

Referring to FIG. 17, in the step of inserting the cover part into the seat part with the band part and the seat part bent in an arc shape (S40), the band part 110 and the seat part 120 are bent in close contact with each other and then can be fixed to a cylindrical jig.

Further, the cover part 150 may be bent and coupled in a shape corresponding to the band part 110 and the seat part 120.

As described above, when the cover part 150, the band part 110, and the seat part 120 are bent and coupled in a shape similar to the head of a person, they easily maintain the bent shape even after being coupled.

The present invention having the configuration described above provides an effect that it is possible to prevent dazzling even though light is radiated forward and sideward by improving a lighting part that is applied to a band type head lantern and it is possible to easily secure a forward visual field by widely irradiating the entire of a target position, thereby being able to increase convenience for users of the head lantern.

Further, it is possible to radiate light to a target position without scattered reflection with a simple configuration even without an additional device such as a reflective plate, thereby reducing the manufacturing cost and improving the quality and durability of the head lantern.

The effects of the present invention are not limited thereto and it should be understood that the effects include all effects that can be inferred from the configuration of the present invention described in the following specification or claims.

The above description is provided as an exemplary embodiment of the present invention and it should be understood that the present invention may be easily modified in other various ways without changing the spirit or the necessary features of the present invention by those skilled in the art. Therefore, the embodiments described above are only examples and should not be construed as being limitative in all respects. For example, the components described as single parts may be divided and the components described as separate parts may be integrated.

The scope of the present invention is defined by the following claims, and all of changes and modifications obtained from the meaning and range of claims and equivalent concepts should be construed as being included in the scope of the present invention.

What is claimed is:

1. A head lantern comprising:

a band-shaped body configured to be worn on a head of a user;

a seat assembly attached to a front of the band-shaped body;

a light emission assembly coupled to the front of the seat assembly;

a lens assembly coupled to a front of the light emission assembly; and a cover configured to cover the emission assembly and the lens assembly, wherein the light emission assembly includes:

a substrate having a flexibility and coupled to the seat assembly;

a plurality of first light emission modules arranged on the substrate with predetermined intervals toward both sides of the substrate from a center of the substrate;

a plurality of second light emission modules arranged on the substrate to be spaced predetermined intervals apart from each other at both sides of the plurality of first light emission modules; and one or more third light emission modules arranged on the substrate to be placed outside the plurality of second light emission modules, wherein the seat assembly includes:

a coupling groove into which the light emission assembly is inserted and coupled;

a top rim extending forward from a top of the coupling groove; and a bottom rim extending forward from a bottom of the coupling groove, wherein the bottom rim protrudes at a first area where the plurality of first light emission modules are located further than a second and a third areas where the plurality of second light emission modules and the one or more third light emission modules are respectively located, so as to prevent light radiated from the plurality of first light emission modules from diffusing to the user's eyes.

2. The head lantern of claim 1, wherein centers of the plurality of first light emission modules are positioned higher than the center of the substrate, and the plurality of second light emission modules and the one or more third light emission modules vertically extend longer than the plurality of first light emission modules.

3. The head lantern of claim 1, wherein the lens assembly includes:

a lens band configured to cover a front of the substrate; and a plurality of lens bodies respectively protruding in a semispherical shape from the lens band, the plurality of lens bodies being positioned corresponding to the plurality of first light emission modules and the plurality of second light emission modules.

4. The head lantern of claim 3, wherein the lens assembly further includes a plurality of light emission element grooves each formed on a rear of each lens body so that the plurality of first light emission modules and the plurality of second light emission modules arranged on the substrate are positioned therein.

5. The head lantern of claim 4, wherein two or more of the plurality of light emission element grooves formed at positions corresponding to the plurality of first light emission modules are deeper at a lower portion than an upper portion thereof to be inclined downward such that light radiated from the plurality of first light emission modules travels forward at 20 to 90 degrees with respect to a rear vertical surface of each lens body.

6. The head lantern of claim 5, wherein two or more of the plurality of light emission element grooves formed at positions corresponding to the plurality of second light emission modules are deeper at a lower portion than an upper portion thereof to be inclined downward such that light radiated from the plurality of second light emission modules travels forward at 0 to 20 degrees with respect to the rear vertical surface of each lens body.

7. The head lantern of claim 6, wherein the two or more light emission element grooves formed at the positions corresponding to the plurality of second light emission modules are configured such that the light radiated from the plurality of second light emission modules travels forward to an area between 0 to 20 degrees with respect to the rear vertical surface of each lens body.

8. A method of manufacturing the head lantern of claim 1, the method comprising:

a) putting the lens assembly on the front of the light emission assembly;

b) inserting the light emission assembly along with the lens assembly into a cover tube;

c) forming the cover by coating the cover tube on the lens assembly and the light emission assembly by heating the cover tube along with the lens assembly and the light emission assembly inserted therein; and d) inserting the cover into the seat assembly coupled with the band-shaped body, the seat assembly being bent in an arc shape.

* * * * *